US005655603A

United States Patent [19]

Schulte et al.

[11] Patent Number: 5,655,603

[45] Date of Patent: Aug. 12, 1997

[54] MUDLINE CASING HANGER MECHANISM INCORPORATING IMPROVED SEALS AND A DETENT MECHANISM FOR INSTALLATION

[76] Inventors: Afton Schulte, 13403 Wells River, Houston, Tex. 77041; John P. Harrington, 14718 Forest Lodge Dr., Houston, Tex. 77070

[21] Appl. No.: 547,976

[22] Filed: Oct. 25, 1995

[51] Int. Cl.[6] ..... F21B 33/00

[52] U.S. Cl. ..... 166/368; 166/89.1

[58] Field of Search ..... 166/368, 89.1, 166/208, 217, 86.1

[56] References Cited

U.S. PATENT DOCUMENTS 5,226,478 7/1993 Henderson, Jr. et al. ..... 166/89.1 X 5,240,081 8/1993 Milberger et al. ..... 166/368 X

*Primary Examiner*—William P. Neuder

[57] ABSTRACT

A mudline casing hanger mechanism is set forth which is particularly intended for use in installing multiple casings which are assembled from a jack-up rig at the surface to the mudline support system of the present disclosure. This utilizes multiple casings which are arranged concentric one within the other and assembles the string of casing joints to the present support structure. This is especially useful when several casing strings are established from a rig temporarily at the location and extend to the mudline. The rig is subsequently moved and the several casing strings above the mudline are disconnected to enable the well to be shut in. All the weight of the well is transferred by casing hangers as set forth so all the weight is supported at the mudline. Later, a different platform is typically installed and the casing strings are reestablished from the mudline to the platform above the water.

26 Claims, 4 Drawing Sheets

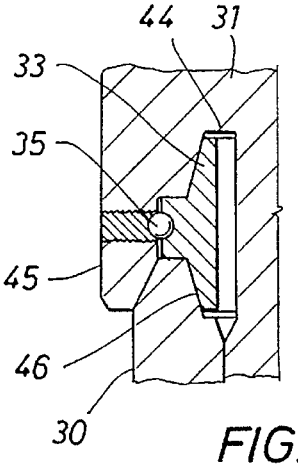
FIG. 2
FIG. 4
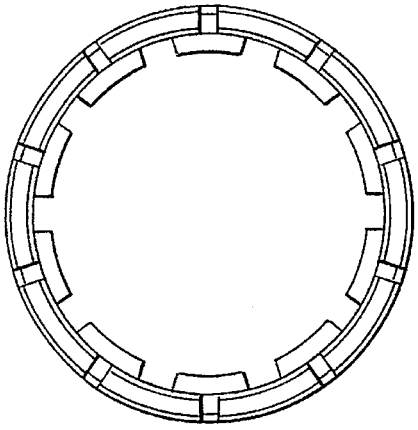
FIG. 3
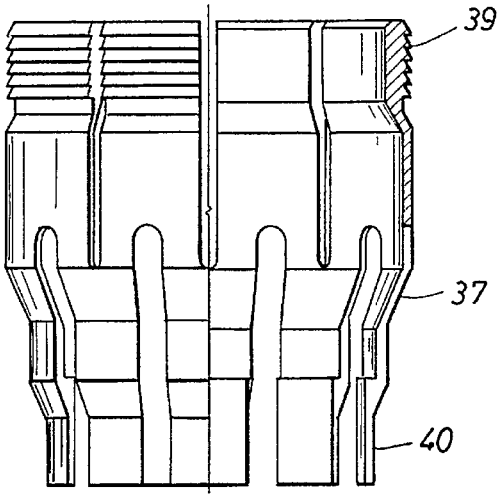
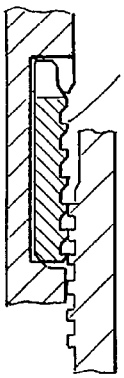
FIG. 9A
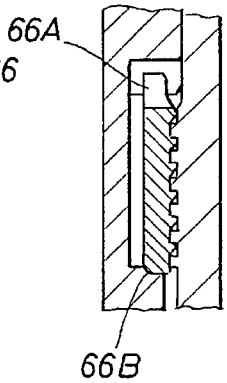
FIG. 9B
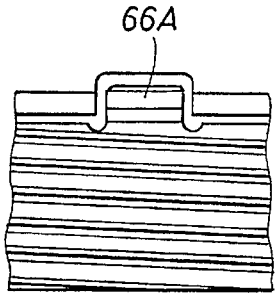
FIG. 9C
FIG. 5
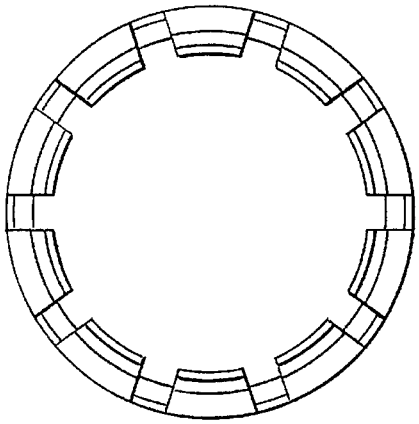

MUDLINE CASING HANGER MECHANISM INCORPORATING IMPROVED SEALS AND A DETENT MECHANISM FOR INSTALLATION

1.0 GENERAL

The present disclosure is directed to a casing hanger system for use in a subsea location. To set the stage, consider the typical situation in which a drilling rig supported on an offshore, jack-up platform is operating in perhaps 100–300 feet of water. The legs of the jack-up rig are extended to the supporting subsea bed and the jack-up drilling platform is elevated above sea level. Depending on the action of the waves and the anticipated wave height, the jack-up platform will be raised anywhere from 30–80 feet above the normal level of the water. From the raised platform, a drilling rig is cantilevered over the aft deck of the platform to conduct drilling operations into the sea bed.

The present system described in this disclosure is intended for use in such circumstances and will allow the well casing above the sea floor to be disconnected at the sea bed after the well has been drilled and plugged. Later, subsequent to the installation of a fixed platform over the well, the well can be reconnected to the platform to enable production to commence.

1.1 OVERVIEW OF OFFSHORE JACK-UP RIG DRILLING OPERATIONS

If a well is drilled from an offshore platform, a significant portion of the casing weight is often supported by the platform. This requires a substantial amount of reinforcing structure in the platform design and associated costs. However, when the wells are drilled prior to the platform installation, using a jack-up rig, the present disclosure enables the wells to be supported at the sea bed, or mudline, thereby offering a substantial weight reduction in structural steel needed in the platform structure to otherwise support the cased wells. Such platforms need only provide lateral stability to the well casing above the sea floor. In addition, the featured disclosure enables the drilling operations to commence while the platform is being constructed. This procedure often permits a year or more of drilling that would otherwise have to be accomplished only after or subsequent to the platform installation.

After the wells have been drilled they are then plugged and the section of each casing string above the sea floor is disconnected; the platform is subsequently installed; and the casing above the sea floor, or mudline, is then re-connected or tied-back to the platform to enable oil or gas production to commence immediately. This procedure brings an early return on investment with associated savings.

1.2 WELL CASING

A listing of the casing sizes used in a well is called the casing schedule. The casing schedule for any well drilled using a jack-up rig will often have the following casing strings:

1.2.1 Conductor Casing, 1.2.2 Surface Casing, 1.2.3 Intermediate Casing, 1.2.4 Production Casing.

All casing strings are commonly assembled from 40 foot joints of pipe. Surface, intermediate, and production casing joints are generally equipped with right hand threaded connections.

1.3 CASING HANGERS

The outer conductor pipe is quite large and is provided with an internally reduced diameter or profile, commonly referred to as a load shoulder, located at an elevation near to the sea bed in order to support a subsequently installed, internal casing string. Each successively smaller casing string is equipped with an assembly of a casing hanger running tool and casing hanger which is threaded onto the casing string and located at such an elevation that the casing hanger will be positioned at the elevation of the load shoulder on the inside of the conductor pipe and thereby be supported at that point.

The outside mechanical features of the casing hangers are configured to engage the profile, or load shoulder, within the surrounding or next larger casing string. Each of the casing hangers is also equipped with an internal profile which provides upwardly facing, support surfaces for suspending the next, smaller, subsequently installed, casing hanger and thus enabling the smaller casing to be supported by the larger casing. In all cases, each successively smaller casing hanger provides a reduced section or internal profile which can be used to support or suspend a casing string installed within it.

Casing hangers provide four primary mechanical features common to all types and styles of hangers. They provide (1) an external support mechanism which engages a profile or load shoulder(s) on the inside diameter of the next larger casing hanger thereby suspending the weight of the smaller casing string; (2) they provide an internal profile which will be used to suspend the next smaller casing string; they also provide two upwardly facing, threaded, female, profiles, (3) one left hand and (4) one right hand, on different diameters to enable the casing to be disconnected and reconnected as desired.

The casing hanger running tool cooperates with the left hand profile and connects the casing above the sea bed to the casing hanger during installation of the well casing. The casing hanger running tool also enables this above sea bed casing to be disconnected by right hand rotation. This above sea bed casing can be disconnected from the casing hanger after the well has been drilled and plugged.

The casing hanger tie-back tool cooperates with the right hand profile and connects the above sea bed casing to the casing hanger by right hand rotation after the fixed platform has been installed.

1.4 CONDUCTOR CASING

As a first step in drilling the well, a large diameter conductor pipe is placed in the sea bed. Indeed, this pipe is placed in the sea bed and extended through the sea bed to a depth sufficient to support the well and prevent drilling fluids, subsequently used, from leaking not out by passing under the lower end of the conductor pipe and thereby breaking down the supporting soil. The conductor casing derives its name from the fact that it conducts the weight of the casing strings into the sea bed soil.

Typical conductor casing sizes are perhaps 24 to 48 inches, and the present disclosure will set forth such a representative conductor pipe of 30 inches in diameter. The conductor pipe is installed by optionally drilling and cementing, or by jetting the pipe into the sea bed. Alternatively, the conductor pipe can be positioned by power driving. It is common for the conductor pipe to be installed to a depth of about only 100 to 300 feet below the sea bed. Thereafter, drilling operations are continued through the interior of the conductor pipe into the formations therebelow.

1.5 SURFACE CASING

Next, a large diameter hole is then drilled through and below the conductor pipe and is drilled typically to a depth perhaps ranging from 500 to 1500 feet. A second casing string, generally referred to as surface casing, perhaps 20 inches in diameter, is then installed in the drilled hole passing through the interior to the conductor pipe. The example given below will refer to a 20 inch surface casing.

The surface casing string is equipped with a threaded assembly featuring of a casing hanger running tool and a casing hanger. The casing hanger assembly is threaded onto the casing at such an elevation that it will be positioned in the location of the reduced diameter or load shoulder on the inside of the surrounding conductor pipe. The casing above the sea bed is threaded into the upwardly facing, female, right hand receptacle of the running tool. The casing below the sea bed or floor is threaded into the downwardly facing, female, right hand receptacle of the casing hanger. The running tool is threaded into the upwardly facing, female, left hand receptacle casing hanger.

The surface casing and casing hanger assembly are lowered into the hole drilled through the conductor pipe, as an assembly, and this surface casing hanger is landed on top of the reduced diameter or profile within the conductor pipe. The conductor casing then substantially supports the weight of the second casing string.

The surface casing is then cemented in place from the lower end of the casing to plug the annular space between the drilled hole and surface casing and also fill the gap between the conductor pipe and the surface casing. This involves a process step of pumping the cement through drill pipe to the bottom of the surface casing. The cement is caused to flow below the bottom end of the surface casing and then upwardly through the annular space on the exterior of the surface casing.

1.6 INTERMEDIATE CASING

The well is usually drilled to a depth of several thousand feet whereupon a third casing such as one measuring 13⅜ inches in diameter is cemented as described above. This third string is referred to as the intermediate casing.

1.7 PRODUCTION CASING

A fourth casing string, referred to as the production casing, is next installed by drilling even deeper and cementing the fourth casing in place. A common size is 9⅝ inches. This provides a fourth casing string which is concentric internally to the first three casing strings. Each of these smaller casing strings is cemented in place as described above. Additional, smaller casing string can also be provided as desired.

1.8 GENERAL FEATURES OF THE MUDLINE SUSPENSION SYSTEM DESCRIBED IN THIS DISCLOSURE

The present disclosure is a system that is especially useful in supporting four or more strings of casing, arranged concentrically in a well borehole, where each is supported by a casing hanger suspended in the previously installed casing string. The weight of each of the casing strings is ultimately supported at the sea bed, and the casing above the sea floor can be disconnected and re-connected as desired.

In particular, during the drilling operation, each casing string above the sea floor is connected to a running tool which is in turn fastened and sealed into a casing hanger. Each running tool and casing hanger are provided with features which enables mutual and joint cooperation with each other to accomplish at least one interfacial metal-to-metal seal. The casing below the sea floor is suspended from the casing hanger. The casing hanger supports the casing below the sea floor, or mudline, prior to cementing in place. The casing above the sea floor extends to the jack-up rig drilling platform. At all times, the weight of the casing in the well is supported at the sea bed.

Upon completion of the drilling, the well is temporally plugged and the casing above the sea floor is disconnected from the casing hanger by backing out or unthreading the running tool from the casing hanger. Likewise, when the well is later connected to or tied-back to the production platform, after the fixed platform has been installed on location, the casing above the sea floor is assembled with the tie-back tool, in place of the running tool first used, at the base of this casing; the casing is then lowered to the casing hanger and is fastened to or threaded into the upwardly facing, female, right hand profile of the casing hanger. Each tie-back tool and casing hanger is provided with features which allow them to jointly cooperate with each other to permit at least one interfacial metal-to-metal seal to be formed. The tie-back tool can also be backed out by unthreading if desired.

The running tool and the tie-back tool can be stabbed in, threaded or unthreaded into the casing hanger as required. In part, this involves the use of the casing above the sea floor fastened to the casing hanger with a running tool during installation of the casing, the subsequent drilling operation, and disconnection of the casing above the sea bed. The running tool, threaded onto the casing, connects the casing above the sea bed to the casing hanger by engaging a set of left hand threads.

When the well is being fled-back to the fixed platform, the running tool is replaced with a tie-back tool at the base of that segment of the casing string that will extend from the sea floor casing hanger to the platform production deck. The tie-back tool cooperates with a set of right hand threads of different diameter within the casing hanger. The casing hanger provides separate, concentric, internal, female threaded profiles for the running tool and tie-back tool.

Briefly, during casing installation and drilling, rotation of the casing to the right releases the running tool (and casing thereabove) from the casing hanger. During the tie-back operation, rotation of the casing in the same direction connects the tie-back tool and the above sea bed casing to the casing hanger. The purpose of this design feature is to ensure that, during removal and subsequent installation of the casing above the sea floor, the casing is being turned in a direction to tighten and not loosen other pipe connections (all right hand) in the casing string.

1.9 REPRESENTATIVE PATENT DISCLOSURES

A representative device which has been set forth heretofore is shown in U.S. Pat. No. 4,580,630. This sets forth a system which enables installation of a casing string. It is not however able to support four different sizes of casing as set forth in the present disclosure. A related disclosure is found in U.S. Pat. No. 5,060,724 which also sets forth a similar casing hanger seal system. Another disclosure of interest relates to seals which are shown in U.S. Pat. No. 5,067,734. That particular reference enhances the foregoing disclosures and provides a seal system utilizing spaced metal bands. U.S. Pat. No. 4,491,346 sets forth a connector system which joins casing members. This features an external lock mechanism utilizing hydraulic cylinders to accomplish alignment.

2.0 DETAILED FEATURES OF THE MUDLINE SUSPENSION SYSTEM DESCRIBED IN THIS DISCLOSURE

2.1 CASING SCHEDULE

There is in this mudline suspension system mechanical support between each of the casing strings to the next smaller casing string at the casing hangers. The present system uses four casing strings. The first is the conductor pipe (usually 30 inches); the second is the surface casing string (usually 20 inches); the third is the first production casing string (usually 13⅜ inches); and the fourth is the second production casing string (usually 9⅝ inches). The casings are referred to by number for the sake of clarity.

2.2 CASING HANGERS

Casing hangers are installed internally in each casing string within the conductor pipe such that when the casing is lowered into the drilled hole, the casing hanger will be in the vicinity of the sea bed. Likewise, the first casing string that is installed supports the second casing string, and so on. Likewise, in all instances, the apparatus of the present disclosure has to be threaded onto each string with the exception of the conductor casing. Disconnection of the conductor pipe is not addressed in this disclosure.

This mudline suspension system enables the casing strings above the sea floor to be disconnected from their respective casing hangers, retrieved if desired, and reinstalled months later and subsequent to installation of the production platform. To do this, the casing hangers of the present disclosure provide substantial advantages over other available mudline suspension systems.

This disclosure also provides two types of support mechanisms for the inner casing strings; one, a common, simple, load shoulder for the surface casing and 13⅜ inch production casing strings; the second is a unique, single piece, detent finger sleeve which supports the 9⅝ inch casing string.

2.3 CONDUCTOR PIPE (FIRST CASING STRING)

The first casing string or conductor pipe is founded by the earth. The conductor casing or first casing string incorporates a simple, internal, load shoulder, or constriction to provide an inclined, upwardly facing surface. This internal load shoulder is fabricated from a solid ring which is welded into the first casing string or conductor pipe. The load shoulder cooperates with a support ring fastened to the outside diameter of the second casing string hanger which achieves coaxial alignment of and support for the second casing string. This flow path is used during installation.

2.4 SURFACE CASING (SECOND CASING STRING)

The outside diameter of the second casing hanger support ring provides a fraction-of-an-inch, radial clearance between outside diameter of the support ring and the inside diameter of the first casing string or conductor pipe. The support ring is perforated axially at a number of locations around the ring so that it does not impede flow in the annular space between the first and second casing strings.

For continuity of terms, this casing hanger will be referred to hereafter as the second casing hanger. For simplicity, each casing hanger will be numbered in accordance with the number of the casing string which is threaded into it. Similarly, this annular space between the first and second casing strings will be referred to as the first annular space; and moving from the exterior toward the interior, the annuli will be numbered sequentially.

Similarly, the first annular space is thus between the first and second casing strings, and in the preferred embodiment, this is the space between the 20 and 30 inches casing strings. This annular space is defined early in drilling because the conductor pipe on the exterior is the first pipe in the well. The second casing string normally is installed using drilling operations. The second casing string is located concentric on the interior of the first casing string. The space between the second and third casing strings is defined as the second annular space and so on for each annular space, created by smaller casing strings which are all sequentially numbered.

2.5 INTERMEDIATE CASING (THIRD CASING STRING)

The second casing hanger provides an internal load shoulder which cooperates with an external support ring on the outside of the third casing hanger. The load shoulder inside the second casing hanger faces upwardly and cooperates with a support ring on the third casing hanger to centralize the third casing string, position it vertically, and provide support for its weight. Similarly, the support ring on the third casing hanger is axially perforated as described above to preclude inhibition of flow in the second annular space. Flow in the annular space will be described later.

2.6 PRODUCTION CASING (FOURTH CASING STRING)

An alternative method of suspension is required to support casing strings smaller than 13⅜ inches since not enough upwardly facing, load bearing, surface area can be incorporated within the third annulus to support the fourth casing string.

In one aspect of the present disclosure, the fourth casing string incorporates a casing hanger featuring a single piece, detent finger sleeve which selectively locates a matching recessed, load carrying, profile within the third casing hanger and engages it. The detent finger sleeve is axially locked by a one piece detent shoulder. The single piece, detent finger sleeve is formed of hard metal and is constructed with alternating slots (from the ends) around the sleeve so that it is formed into two sets of flexible fingers, top and bottom. The bottom detent fingers are able to flex radially inwardly or outwardly to traverse constrictions or internal shoulders at the time of installation. The axial interval of the sleeve between the top and bottom detent fingers does not flex radially and provides a stable load carrying sleeve under all conditions.

The detent fingers on top of the single piece, detent finger sleeve feature segments of an external, cylindrically symmetric, multiple groove, profile. These detent fingers are spring biased outward in a radial direction. This pre-loads the sleeve upper detent fingers and enables them to snap into position in the matching and mating profile located inside the third casing string hanger.

The detent fingers at the bottom of the single piece, detent finger sleeve feature segments of an internal, cylindrically symmetric, single step constriction. The bottom detent fingers are spring biased inward in a radial direction. The fourth casing hanger features a detent groove around the body of the hanger. The upper side of this groove features a downwardly facing, slightly inclined surface which cooperates with the single step constriction in the lower detent fingers.

The one piece sleeve has lower detent fingers to provide an axially inward pre-load restraining them in position in the detent groove located on the outside of the fourth casing hanger.

As the fourth casing string is lowered through the third, the top set of detent fingers of the fourth casing hanger single piece, detent finger sleeve locate and snap into the recessed matching profile in the third casing hanger, preventing the detent finger sleeve from moving lower. At that point, increasing weight is placed on the lower detent fingers, as a result of their interaction with the slightly inclined surface on the upper side of the casing hanger detent groove, and eventually causes the lower fingers to expand over the inclined upper edge of the detent groove allowing the lower fingers to ride up over the edge of the detent slot. The fourth casing hanger then descends under load an incremental distance forcing the lower step of a two step diametrical upset in the fourth casing hanger body beneath the top detent finger tips; the upper edge of the second step prevents further downward motion of the casing hanger. This action produces a radial lock in the top detent fingers and supports the weight of the fourth casing string. Weight is transferred from the upper edge of the two step diametrical upset through the multiple groove profile of the singe piece, detent finger sleeve and into the recessed profile of the third casing hanger.

Because the detent finger sleeve is made of one piece construction and is in all instances secured axially to the forth casing hanger by the lower detent fingers, it is highly effective in locating the upper detent fingers and allowing them to flex radially outwardly as required without racking. Moreover, this mode of flexure enables the detent fingers to ride over any normal constriction within the third casing string and to seat at the matching location.

As mentioned above, the single piece, detent finger sleeve is formed with a plurality of splits in it. The splits are alternating from the two respective ends of the sleeve, thereby defining an interleaved solid ring structure which is able to contract or expand radially for easy installation. Once the fingers have located the matching profile and snapped into position, the sleeve is held stationary until increasing weight causes release of the lower detent fingers and the casing hanger and casing descend a further increment to complete locking the upper fingers radially and axially. The installation is then perfected. The tips of the upper detent fingers support the fourth casing string weight as shear/compression elements.

Typically, in other mudline suspension systems, the function of the detent finger sleeve is accomplished using what is commonly referred to as an expanding hanger. Expanding hangers provide a radially expanding cage structure on the outside of the hanger body capable of expanding radially throughout their length. As a result, the inside diameter of the caged structure is allowed to expand significantly beyond the outside diameter of the casing hanger. This characteristic on occasion results in the expanding hanger cocking or rotating about an axis normal to the casing string causing it to bind. The inside diameter of a single piece, detent finger sleeve, defined in this disclosure, being circumferentially continuous at the base of the upper and lower detent fingers, does not appreciably vary and is not prone to cocking or binding.

2.7 SEALING FEATURES OF THE SYSTEM

Of importance to the present disclosure is the fact that a number of connections must be made and it is sometimes necessary to first install casing and thereafter remove it, perhaps thereafter reinstalling the same size casing, and carrying out a number of installation steps. In the subsea environment, it is difficult to complete the connections between the several casing strings. Nevertheless, each connection must be made and it must be a leak proof connection. The importance of the sealing increases from the outer to inner casing strings. In part, this derives from the fact that the operating pressures experienced in the first and second annular spaces are not very high. By contrast, production fluids recovered from the well borehole are typically observed on the interior of the fourth casing string, and that requires very secure connections which are substantially leak proof. Pressure levels at the producing formation can be very high. This means that the third annular space must be carefully sealed so that the fourth casing string cannot leak into the third annular space.

In several aspects of the present disclosure, pressure isolation from the respective casing strings into the surrounding annular spaces is needed. Likewise, this is done so that there is a desirable sequence in which the annular spaces can be cemented to anchor the various casing strings together.

A significant feature of all of the casing hangers, two through four, is the incorporation of one or two fixed or removable, metal-to-metal, seals as appropriate. The removable metal-to-metal seal features a seal ring for use in both drilling and tie-back operations. The removable seal rings are supported in a protected shoulder of the running and tie-back tools by a freely rotating support system, incorporating ball bearings. This has advantages at the time of installation and provides a circumferentially, frictionless support system during make-up of the running or tie-back tools to their casing hanger.

The second metal-to-metal seal featured in this disclosure incorporates a sliding, tapered lip on the lower tip of the running and tie-back tools providing back-up metal-to-metal sealing. This has the advantage of an installation with the absence of elastomeric seals. In a more desirable aspect, leakage is prevented by the metal-to-metal sealing.

An important feature of both metal-to-metal seal element designs is that the seal ring and tapered lips are coated with a three layer coating system of ductile seal enhancing coatings. First a thin layer substrate of pure copper is applied; next a second layer of pure silver is overlaid; third a protective, lubricating surface layer of molybdenum disulfide is applied.

The copper layer provides enhanced shear strength in bonding the silver layer to the steel pipe. Copper plates readily bond to steel and form a foundation for the silver layer. The silver layer provides a ductile surface that will deform under contact loads between the running or tie-back tools, and the casing hanger. This deformation fills voids in the mating steel surfaces to preclude leakage through the voids. The molybdenum disulfide coating provides corrosion resistance for the silver coating and lubricity to the mating interfaces.

3.0 DISCLOSURE

The present disclosure is set forth in substantial detail, outlining first the context in which the system is installed. This enables a description in depth of the system. In some aspects, it will be described prior to installation and in other aspects it will be described during and/or after installation. Installation will be achieved in the context of a typical drilling sequence. The routine presupposes a certain casing schedule. This casing schedule is intended for purposes of illustration, not limitation. For this purpose, a pipe schedule for the casing provides the representative context of the present disclosure. In this aspect, FIG. 1 shows four concentric casing systems which are denoted as the first casing string, etc. proceeding from the exterior to the interior in which the casing hanger of the present invention is installed and which also includes the seals and hangers appropriate for this problem provided by the present disclosure. In addition to that, specific features will be referred to in the other views. These views will set forth some detail and provide an explanation for the various components which makeup the mudline casing hanger suspension system of the present disclosure.

3.1 DETAILED DESCRIPTION OF THE DRAWINGS

So that the manner in which the above recited features, advantages, and objectives of the present invention are attained and can be understood in detail, a more detailed description of the invention, briefly summarized above, may be had by reference to the embodiments thereof which are illustrated in the appended drawings.

FIG. 3 is a side view, partly in section, showing details of construction of a single piece, detent finger, casing hanger having partial slots alternating around the ring;

FIG. 4 is an top view of the detent finger casing hanger sleeve shown in FIG. 3;

FIG. 5 is an bottom view of the single piece, detent finger casing hanger sleeve shown FIG. 3 where this view is at the opposite end of the structure;

Figure 6:
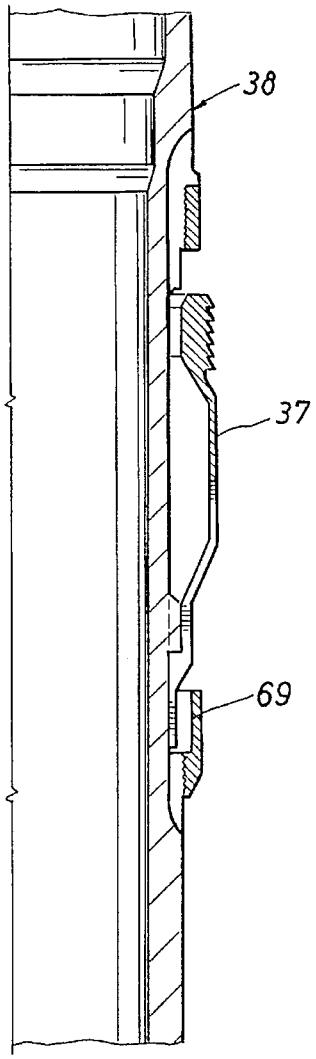
Figure 7:
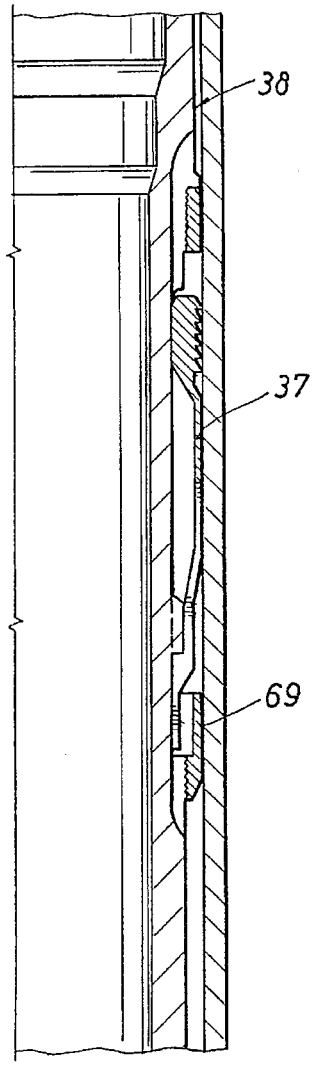
Figure 8A:
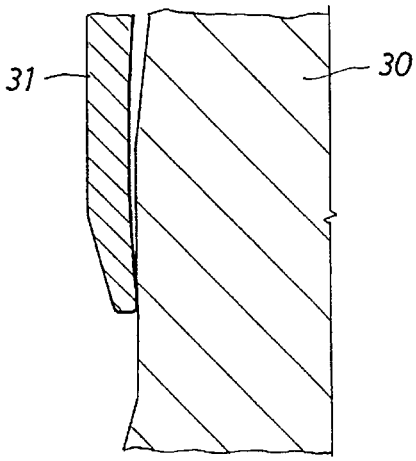
Figure 8B:
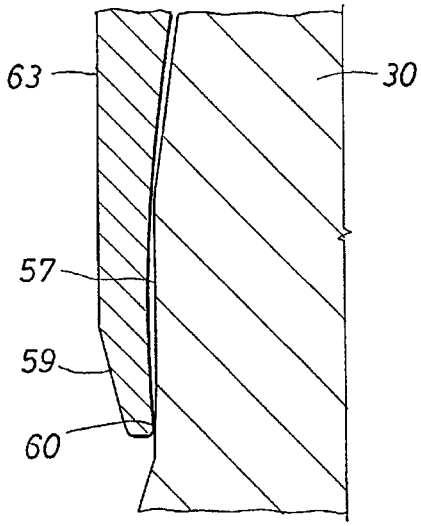

FIGS. 6 and 7 both show the same aspect of the device at different stages of proceedings so that the change in position can be more readily explained;

FIGS. 8A and 8B are sectional views showing details of both running tool and tie-back tool metal-to-metal seals; and FIGS. 9A and 9B are sectional view showing a split threaded-ring profile.

3.2 DETAILED DESCRIPTION OF THE PREFERRED EMBODIMENT

Figure 1A:
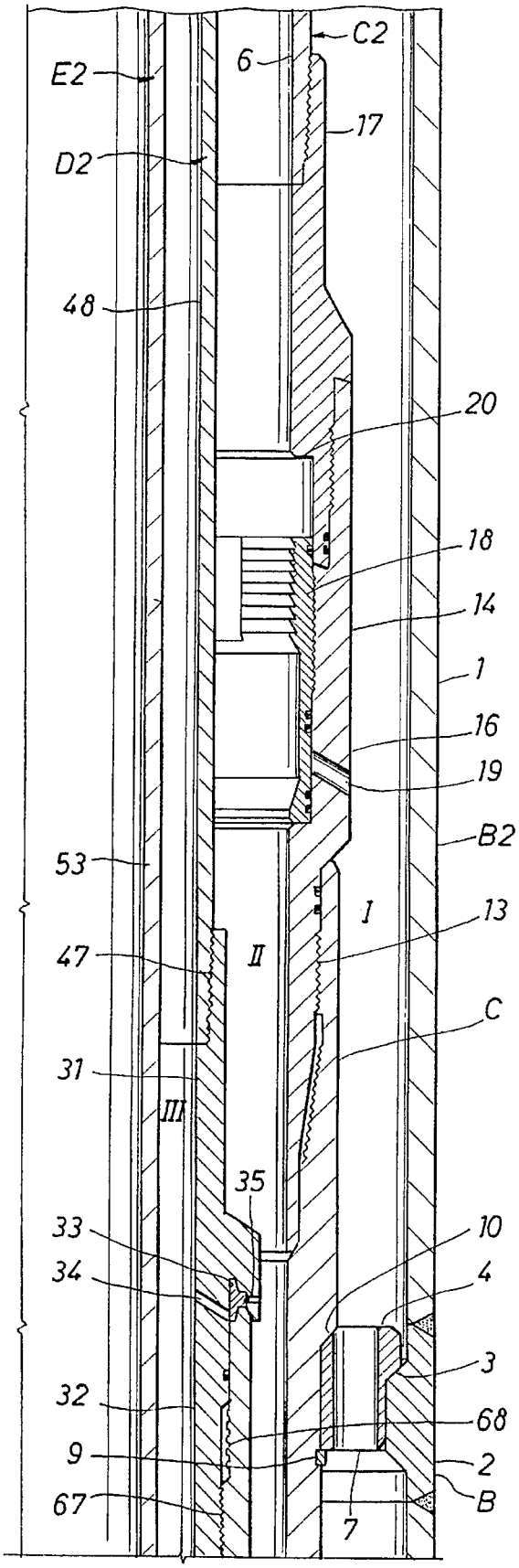
FIGS. 1A & 1B are sectional views through a four casing system connected by the casing hanger system of the present invention and which further includes additional components involved in the casing hanger system providing appropriate seals and support mechanisms.
Figure 1B:
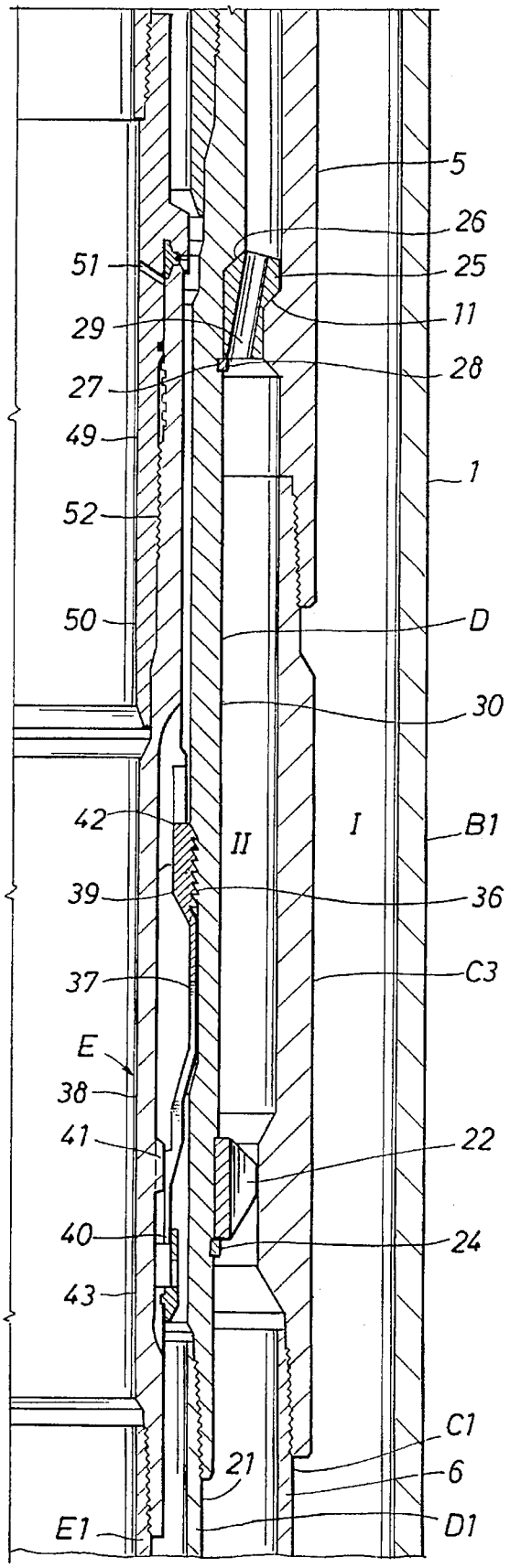

The letter A identifies the casing system of the present disclosure which includes the casing hanger of this disclosure. The letter A will then refer to what is known throughout this disclosure as a mudline casing hanger suspension system. This involves several concentric casing strings. The description will begin with the exterior casing string and proceed to the interior. That first casing string will be described and its operation in conjunction with the system, A, will be set forth. In that sense, the description will begin with the installed first casing string and move inwardly to the other components of the structure. Thereafter, a sequence of operations is involved. In FIG. 1 of the drawings, the designation B1 identifies that portion of the first casing string formed of conductor pipe joints 1 which are below the sea bed. The designation B2 identifies that portion of the first casing string formed of conductor pipe joints 1 which are above the sea bed. It is the outermost casing string. Using as a representative casing schedule, assume for purposes of description that the casing string B is a welded string of conductor pipe joints 1 having a nominal size of 30 inches, and that it is 300 feet in length, extending approximately 150 feet into the sea bed. The first casing string B typically is installed either by (1) jetting to wash a hole in the sea bed, (2) hammering the casing B with a power driver, or (3) alternatively by drilling a suitably sized hole and then inserting the casing into it; and then cementing the casing B in place.

Assume for purposes of description that the casing string B is adequately anchored in the sea bed. This is achieved by the method of installation which method above includes either jetting away the sand of the sea bed, driving, or alternatively by drilling and cementing the string of casing. Sufficient resistance to movement is achieved. The casing B is formed of the joints 1 and a short sub 2 which is welded to the connected joints 1. The sub 2 includes an inwardly protruding shoulder 3. The shoulder provides a foundation for a support ring 4. The ring 4 is fastened to the first casing hanger assembly 5. The ring 4 has an external face which includes an overhanging shoulder to abut the shoulder 3. When the second casing hanger assembly 5 is installed together with the second casing string C in the first casing string, the support ring 4 extends radially inwardly to centralize the second casing string C so that the ring 4 can land on the load shoulder 3 and support the next casing string C.

In this instance, assume again for purposes of discussion that the casing 1 is 30 inches in diameter while the next casing string C is 20 inches. Assume additionally that the third and fourth casing strings D and E are 13⅜ inches and 9⅝ inches respectively. For purposes of example only, typical lengths are implemented such as 300 feet for the conductor pipe, then 1,500 feet of the 20 inch casing, then 10,000 feet of the 13⅜ inch casing, and finally 20,000 feet of the smaller casing concentric on the interior. If the well is to be drilled even deeper, an even smaller casing string is used to extend below the fourth casing string. As noted, the casing string B is formed of individual joints of casing 1 and the individual joints of the smaller casing are given specific reference numerals.

The next casing string C is the 20 inch casing string in this example in which C1 denotes the portion of the casing below the sea bed and C2 denotes the casing above the sea bed. To this end, the ring 4 is constructed to fit around the first casing hanger 5. This means that the ring 4 must be cut to a particular inside diameter. The casing hanger 5 includes a downward facing shoulder that applies the weight of the second casing string C to the support ring and thereby onto the load shoulder 3.

The second casing string is identified generally by the letter C and is formed of casing joints which are identified by the numeral 6. This defines an annular space I which is the first annular space. The first annular space has communication above and below the ring 4 because the ring 4 is constructed with perforations 7 in it. This feature permits flow in the annular space I so that the ring 4 does not choke flow and inhibit casing installation. The casing string C is formed of threaded joints such as the lowermost casing joint 6 shown in FIG. 1 of the drawings.

The joint 6 threads to a sub 8 which is a 20 inch casing hanger body. The sub 8 is constructed with a female threaded connection at the lower end and two concentric, threaded connections at the other end which will be discussed in detail hereinafter. The casing hanger assembly 5 includes the casing hanger body 8 the support ring 4 and the support ring retainer 9. The support ring 4 is constructed to conform with the second casing hanger body 8 and is held in place during installation by the support ring retainer 9. After installation, the casing hanger is held in place by gravity. A reduced diameter on the lower exterior portion of the second casing hanger body 8 defines a downwardly facing shoulder 10 that seats on the ring 4 supporting the weight of the casing string C. The casing hanger body 8 includes an inwardly protruding load shoulder 11 which defines an internal shoulder for purposes to be detailed. The casing hanger body 8 extends upwardly to two separate, concentric female threaded connections 12 and 13.

As shown in the drawings, the details are somewhat different as depicted at the left and right sides of the centerline of FIG. 1. On the left, a running tool assembly 14 is shown connected with the 20 inch casing hanger assembly 5 at the threaded connection 13. On the right, a tie-back tool 15 is illustrated. The running tool assembly 14 is threaded to the casing hanger assembly 5 and enables the hanger to be lowered into the well. This is accomplished at the time of installation of the second casing string C. This casing string is assembled from the surface using casing joints 6 and this assembly continues until the desired length of sub-sea floor casing has been made-up. At this time the running tool assembly 14 is made up to the running tool threaded profile 13. Successive joints of casing 6 are then made-up to the running tool assembly 14 until the entire string C has the requisite installed length extending from the bottom of the existing well bore to the drilling platform. The second casing hanger assembly 5 locates the support ring 4 on the exterior so that support ring 4 lands on the load shoulder 3 preventing further penetration into the well borehole by the second casing string C. So to speak, the weight of the second string C is rested on the support ring 4 and the support ring transfers the weight of the second casing string C to the first casing string B1. The weight transferred can be substantial.

At this juncture, the casing hanger running tool assembly 14 should be considered. It is connected with the second casing string C which extends thereabove to the very top of FIG. 1 of the drawings and to the drilling rig (omitted for clarity). This second casing string threads into the running tool assembly 14 which includes the running tool body 16, the running tool mandrel 17 and the circulation port isolation sleeve 18.

A circulation port 19 which opens into the first annular space I is controllably opened and closed depending on requirements. The circulation port 19 is closed in the running configuration as illustrated. The port is closed by the circulation port isolation sleeve 18 shown in the down position. In that position, there is no flow from the second annular space II through the port 19 into the first annular space I. There are seals above and below the port 19 to isolate the annular space I. The isolation sleeve 18 however is able to move upwardly. When it moves upwardly, its travel is limited by the shoulder 20 in the running tool mandrel 17 after the upward movement of the sleeve 18 exposes the port 19. The circulation port isolation sleeve is captured so that it opens or closes the circulation port 19. As will be understood, the port is located between upper and lower seal rings. The circulation port is replicated around the periphery so that the aggregate flow path cross sectional area of the several ports 19 is adequate for the requirements. The circulation port 19 is used in the second casing suing C installation and cementing procedure as will be detailed. The circulation port 19 is not a feature of the casing hanger tie-back tool 15 since the tie-back tool is used only during reconnection of the casing above the sea floor C2 and after the casing C1 has been installed and cemented in place.

The tie-back tool 15 is shown on the right side of FIG. 1 with a casing joint 6 threaded into it. The casing 6 is replicated by similar joints to reach the surface so that continuity from the surface of the second casing string C is accomplished. The tie-back tool 15 operates with the female, tapered, tie-back threaded profile 12 internal to the second casing hanger assembly 5. The preferred thread form of the profile 12 is modified buttress. The tapered configuration assists in aligning the tie-back casing C2 and the tie-back tool 15 with the second casing hanger 5. The top of the tie-back tool features a threaded female receptacle 56 into which a casing joint 6 is threaded. The casing 6 is replicated by similar joints to reach the surface so that continuity from the surface of the second casing string C is accomplished from the drilling rig to the bottom of this casing string.

A shoulder 62 above the threaded profile of the tie-back tool 15 provides a positive stop for making-up the tie-back tool into the second casing hanger 5 and to prevent damage to the metal-to-metal sealing profile 59 from over torquing.

The metal-to-metal tie-back tool seal is shown in FIG. 8. The second casing string tie-back tool 15 features a metal-to-metal seal on the internal surface 57 of the female socket provided at the top portion of the second casing hanger 5. The cross-sectional profile of the lower end of the tie-back tool 59 is designed to provide an interference fit over the selected length of the cylindrical portion of the bottom of the female socket 57. The cross-sectional profile of the lower tip of the tie-back tool is compressed under the action of the interference fit; this condition creates the metal-to-metal seal at the nub 60 external to the bottom tip of the tie-back tool 15. Any pressure existing internally to the second casing string C acts on the internal surface of the lower portion of the tie-back tool 58. This action compresses the nub 60 against the internal, cylindrical, surface 57. The cross sectional area at the hub 60 is designed to provide virtual constant stress over its length. This feature provides for maximum radial deflection of the tie-back tool lower tip 59 enhancing the reliability of the seal. Two dove-tail grooves 61 are cut around the neck of the tie-back tool 15 just below the positive stop shoulder 62. These grooves retain O-rings, not shown, which act as secondary, back-up seals for the more reliable metal-to-metal seal.

An important feature of the tie-back, metal-to-metal seal element is that the lower, cylindrical, sealing surface 57 of the casing hanger upper female receptacle is coated with a uniform layer of pure copper. The machined surface is rather smooth, having a surface of 16 RMS or better smoothness. The copper is applied to bond between steel and the next layer of silver. The running and tie-back tools metal-to-metal sealing surfaces 60 are coated with three layers of ductile, seal enhancing coatings. First is the thin layer substrata, an effective thickness of pure copper. Second is a layer of pure silver, relatively thin, usually less than about 0.003 inch max. thickness. Third is a protective, lubricating layer of molybdenum disulfide, perhaps up to about 0.003 inch max. This layer is a mix of metal particles and plastic which bonds after application. The copper layer provides enhanced shear strength in bonding the silver layer. The silver layer provides a ductile surface that deforms under contact loads between the running or tie-back tools and the casing hangers seal pockets. The deformation of the silver fills any voids in the mating steel surfaces to preclude leakage. The molybdenum disulfide coating provides corrosion resistance for the silver coating and lubricity to the mating interfaces.

Attention is now directed to the third casing string D which is again exemplified as the 13⅜ inch casing string. In the example given, it is 10,000 feet in depth. It is desirable to anchor this casing string to the other casing strings just mentioned. This casing string is assembled from several joints of casing 21 having one or more centralizer protrusions 22 along the third casing string joint under the third casing hanger 23. The centralizers 22 assist in coaxial alignment of the casing D inside the casing C. The protruding centralizer 22 preferably has a single piece construction. It is held in place by a retaining ring 24 located below the centralizer 22. The centralizer 22 centralizes in the center of the centralized extension C3 while allowing annular flow.

The third casing hanger support ring 25 is constructed with a conforming external shoulder which overhangs the load shoulder 11 internal to the second casing hanger assembly 5 previously mentioned. In addition to that, the support ring 25 has an internal shoulder which conforms with the external face of the section 26. The support ring 25 transfers weight of the casing string D to the casing string C. A groove 27 is defined below the support ring 25 to receive the retaining ring 28 which anchors the support ring 25 in location. The support ring is perforated at spaced openings 29 to enable fluid flow through the ring 25 so that the flow of drilling fluids is not inhibited, and annular space II can be filled through these openings. There is a fluid flow path in this area which will be discussed in detail hereinafter.

Figure 2A:
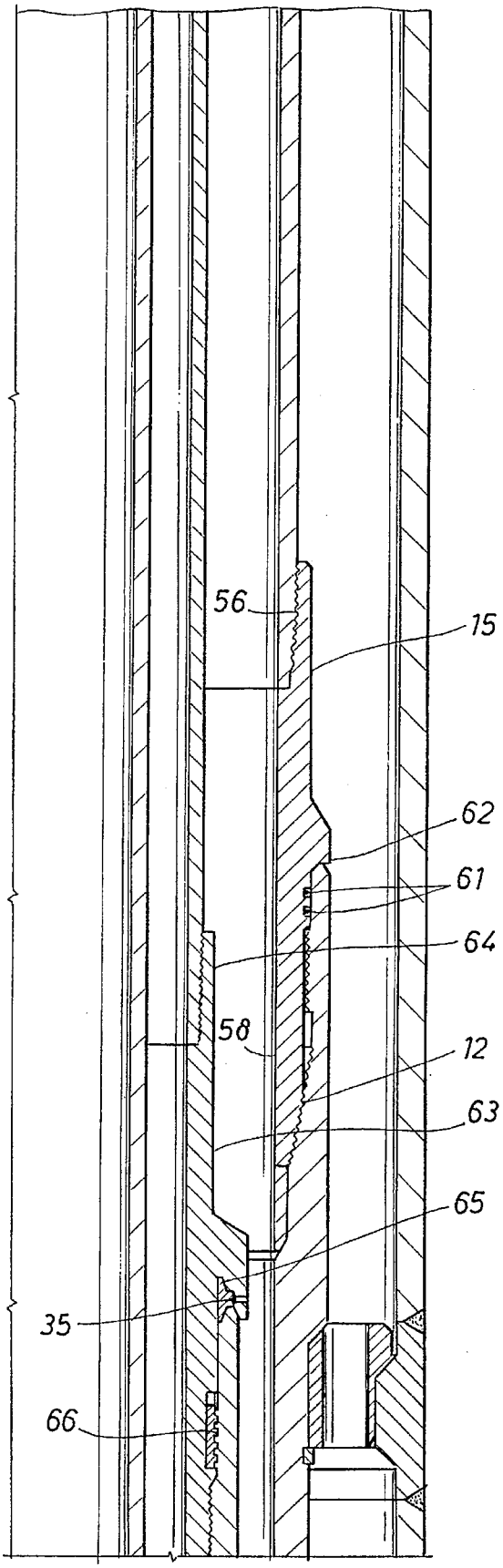
FIGS. 2A and 2B are enlarged sectional views through a seal showing details of the seat which are associated with a particular casing string in the disclosure.
Figure 2B:
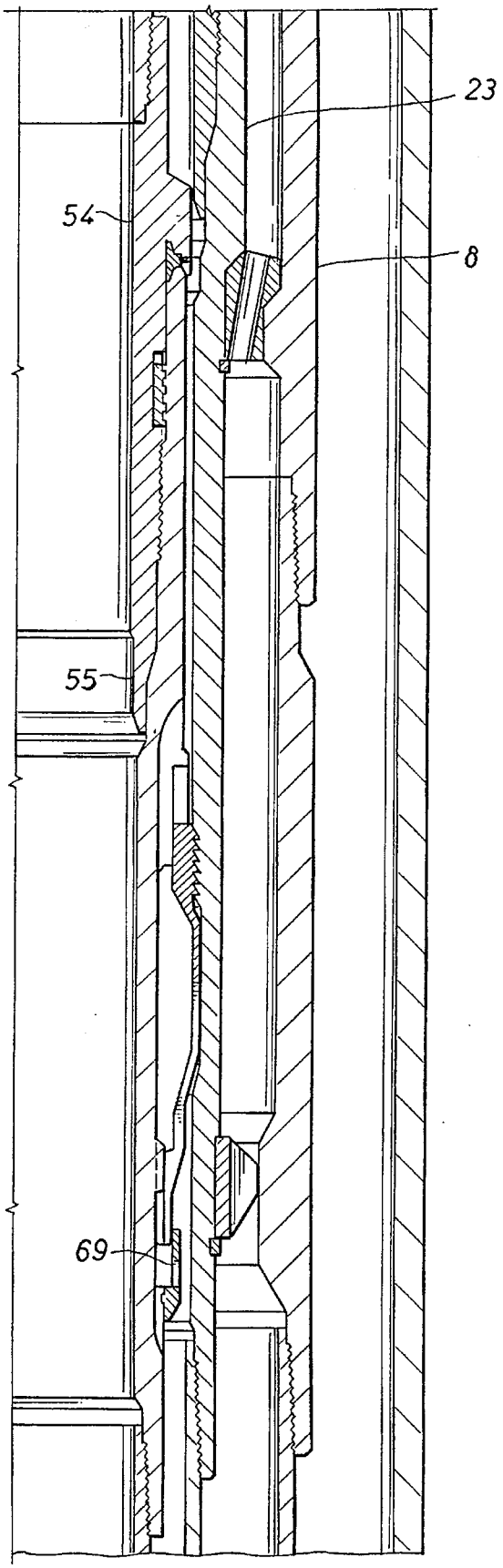

On the left side of FIG. 1 of the drawings, the device is shown for installing or running into the well borehole and suspending the 13⅜ inch casing string D. To this end, the third casing hanger assembly 30 extends upwardly where it terminates with a running tool assembly 31. The running tool assembly 31 includes the running tool body 32 the metal seal ring 33 and the ball retainers 35. The running tool assembly 31 threads into the third casing hanger assembly 30 at 67 and forms a metal-to-metal leak proof connection with the casing-hanger assembly 30. The running tool body 32 incorporates another port 34 from the interior of the third casing string D to the exterior annular space II. This port 34 is replicated at a number of locations to provide an adequate fluid flow into the second annular space II after the ports 34 are uncovered by upward movement of the running tool assembly 31. There is a metal-to-metal seal construction involving the upper end of the third casing hanger assembly 30. Seal construction is disclosed in greater detail in FIG. 2 of the drawings. FIG. 2 shows the metal-to-metal seal generally identified at 33.

The lower portion of the third casing hanger assembly 30 features an elongate section which provides an interior female profile 36 to accept a single piece, detent finger sleeve 37 which is a part of the fourth casing hanger assembly 38 which will be described hereinafter.

Going now to FIG. 2, the structure illustrated there includes the upper cylindrical end of the third casing hanger assembly 30. The running tool assembly 31 is shown with a ball bearing supported metal-to-metal seal ring 33. The ring is captured in a groove 44 in an overhanging lip 45 of the running tool body 32. Moreover the axial load of that portion of third casing string D2 above the casing hanger assembly 30 is supported jointly on the seal member 33 which is captured by the groove and the overhanging lip 45 on the running tool body 31. This groove is concentric with the overhanging lip 45 which conforms to the top end profile 46 of the third casing hanger body 23. This enables the seal ring 33 to provide a full and complete seal to prevent leakage through this connection. Going further up from the seal assembly shown in FIG. 2 of the drawings, the running tool body 32 terminates at the female threaded connection 47 and threads to the top most casing joint 48 which extends to the top of FIG. 1 of the drawings.

On the right side of FIG. 1 of the drawings, the device is shown for installing or tying-back 13⅜ inch casing string D2. To this end, the third casing hanger assembly 30 extends upwardly where it terminates with a tie-back tool assembly 63. The tie-back tool assembly 63 includes the tie-back tool body 64, the 13⅜ inch metal seal ring 65, the ball retainers 35 and the male, threaded, split ring 66. The tie-back tool assembly 61 threads into and forms two back-up metal-to-metal leak proof connections with the casing-hanger assembly 30. The split ring 66 shown in FIG. 9 incorporates three torque lugs 66A which make up the tapered thread into the casing hanger body 23 by rotating tie-back tool body 64 to the fight. The split ring 66 bottoms out on a 45° bevel surface 66B which locks the split ring 66 in the outward expanded position into the right hand thread 68 as shown in FIG. 9. There is a metal-to-metal seal construction involving the upper end of the third casing hanger tie-back tool body 64 and another back-up metal-to-metal seal at the lower tip of the tie-back tool assembly 63. Seal construction is disclosed in greater detail above and is shown in FIGS. 2 and 8 of the drawings.

Going to the fourth casing string E, it is 9⅝ inches in diameter and smallest casing string used in this illustration. This does not restrict the ability to incorporate additional smaller casing strings within casing string E and similarly configure those smaller casing strings. Casing string E incorporates a 9⅝ inch casing hanger assembly 38. On the left side of FIG. 1 of the drawings, the device is shown for installing or running into the well borehole and suspending the 9⅝ inch casing string E. To this end, the fourth casing hanger assembly 38 extends upwardly where it terminates with a running tool assembly 49. The running tool assembly 49 threads into and forms a metal-to-metal leak proof connection with the casing-hanger assembly 38. The running tool body 50 incorporates a port 51 from the interior of the fourth casing string E to the exterior annular space III. This port 51 is replicated at a number of locations to provide an adequate fluid flow into the third annular space III after the ports 51 are uncovered by upward movement accompanying partial unthreading of the running tools left hand threads 52. There is a metal-to-metal seal construction involving the upper end of the fourth casing hanger assembly 38. Seal construction is previously disclosed in greater detail in FIG. 2 of the drawings.

The fourth casing string E is suspended by the third casing hanger assembly 30. The upper edge of the fourth casing hanger assembly. 38 terminates at a replaceable metal-to-metal seal of the sort identified in FIG. 2 of the drawings. The casing hanger running tool assembly 49 threads into a left handed profile 52 at the top of the casing hanger assembly 38. The running tool assembly 49 is threaded to a joint of casing 53 which is the lower most joint in the casing string which extends from the top end of FIG. 1 of the drawings to the drilling rig. This is shown on the left side of FIG. 1 of the drawings.

One aspect of the present disclosure is that the forth casing string E is supported with a single piece, detent finger sleeve 37. The single piece, detent finger sleeve is retained in position by the retainer sleeve 69. It is cylindrical and provides added flow in the annular area. As mentioned above, the detent sleeve is formed with a plurality of splits in it (see FIG. 3). The splits are alternating from the two respective ends of the detent sleeve, thereby defining an interleaved one piece structure which is able to radially contract or expand, top and bottom, for easy installation. The upper load shoulders have sharp profiles for penetrating hard objects that could get positioned in the third casing hanger serrations 36. This pre-loads the detent fingers with a radial spring bias enabling the top detent fingers 39 to snap into position in the female profile 36 in the third casing hanger body 23 and the lower detent fingers 40 expand and slide over the detent upset 41 on the exterior of the fourth casing hanger body 43. Once the casing hanger detent finger sleeve has shifted to the locked position, the installation of the forth casing string is perfected. The serrations 36 are located internally in the lower portion of the third casing hanger body 23. The top of the hanger detent finger sleeve 39 supports a downwardly facing shoulder 42 on the fourth casing hanger body 43 thereby supporting the fourth casing string E. The shoulder 26 on the third casing hanger body 23 applies the weight of the third casing string D to an integrally connected support ring 25 which is in turn supported by the second casing hanger load shoulder 11.

It will be recalled that the left side of FIG. 1 illustrates a running tool in the fourth casing string E. A tie-back tool 54 is shown on the right side of FIG. 1 in the casing string E. This has a differently constructed lower end 55 on the tie-back tool 54. The tie-back tool 54 is constructed with a similar metal seal 33 (see FIG. 2).

To review several aspects of the single piece sleeve (shown in three different views in FIGS. 3, 4 and 5) which is formed of a single piece of metal, it is cut with the interleaved slots from opposite ends. It will be observed the slots are sufficiently long that they extend from the respective ends and overlap. This slot overlap enables the ring having a nominal diameter to fit during its installation and deflects radially inwardly or outwardly. In other words, the sleeve can expand or shrink. In that sense, the slot overlap responds to hoop forces to take on the diameter required at the particular circumstance. This accommodates the hoop stresses in the ring to assure sung and tight fastening when installed. Another aspect derives from the movement of the defined fingers at the lower end. The fingers are collectively deflected radially inwardly or outwardly as required. This assists in anchoring the ring at the time of installation, in holding the installed ring at the required location, and assuring connection and anchoring. The sleeve is installed to snap into place and stay in place and forms an enduring connection which can stay for years. When installed for that interval, the device still operates in the same fashion.

The installed sleeve (FIG. 3) will probably be exposed to production fluids including oil and salt water. Without regard to the salt content or the pH of the produced fluids which are typically at elevated temperatures, the corrosive nature of the production fluids will not destroy the quality of the sleeve. While the sleeve is installed on the exterior of the pipe string which carries the production fluids at pressures which can be as great as 20,000 psi and which pressure is primarily dependent on formation pressure, if there is leakage of salt water to the vicinity of the sleeve, the salt water with the salt content will not damage the hanger sleeve.

FIGS. 6 and 7 considered jointly show the performance of the single piece sleeve 37, better illustrated in FIG. 3 of the drawings. FIG. 3 shows how the fingers deflect and conform with the surrounding structure. FIGS. 6 and 7 show how the fingers at the lower end of the sleeve 37 are deflected and find a mating and matching seat.

References to the running tool or the tie-back tool in the third string D are something of a digression to connect the third string D with the fourth string E. This will become more apparent on the description of the method of assembly. This will become more apparent as the operative steps are described through the installation of the several casing strings in the well. Certain operative aspects will also be detailed at that point. In addition, a sequence of operation will be given which involves execution of certain steps during the assembly of the four casing strings in the well borehole so that complete operation is understood. This description will spotlight the value of the ring 40 in operation.

4.0 AN EXAMPLE OF CASING INSTALLATION

4.1 INSTALLATION OF THE CONDUCTOR PIPE

After a jack-up rig has been raised at a required location, the first casing string is placed in the sea bed. Assume in accordance with the example given above that the casing B is 300 feet in length and has a nominal measure of 30 inches. The conductor pipe B is inserted into the subsea by either jetting, drilling or power driving and the casing hanger support shoulder 3 is located at approximately the elevation of the sea bed. The conductor pipe extends sufficiently deep to support the well. The weight and consistency of the surrounding soil will not break down from the hydrostatic head of the internal drilling fluids. At that stage, the conductor pipe installation is complete.

4.2 INSTALLATION OF THE SURFACE (SECOND) CASING STRING

The next step involves drilling through the conductor pipe with a large drill so that the well is extended perhaps 1,500 feet, thereby permitting installation of the 20 inch casing string C. In the example, the 20 inch casing next is cemented in place. Prior to cementing, the 20 inch casing is supported exclusively by the conductor pipe with the support ring 4 of the 20 inch casing hanger assembly 5 shifting the weight of the casing string C to the conductor pipe load shoulder 3. This properly supports the weight of the 20 inch casing C. The 20 inch casing string is then cemented in place by known methods.

Cement is forced down through a string of drill pipe lowered to the bottom of the casing string C and is caused to flow out of the bottom of the casing and back up in the annular space including the first annular space I. Generally, a sufficient volume of cement will be pumped so that an indication of the cement will be visible within the annular space I at the top of the casing, near the rig floor. At this point in time and prior to the cement hardening, it is necessary to wash out the additional cement above the top of the casing hanger running tool assembly 14 in that portion of the annular space I bounded by the casing B2 and C2 above the hangers in order to enable the later removal of the casing and running tool assembly 14 after the well has been drilled.

To accomplish this, an internal isolation port sleeve shifting tool is fastened to the drill pipe and lowered into the 20 inch casing C and engaged to the isolation port sleeve 18. The isolation port sleeve is elevated by rotating it via the drill pipe work string thereby exposing the wash ports 19 located in the top of the 20 inch casing hanger running tool assembly 14. Water is then pumped down the 20 inch casing string C and through the wash ports 19. The resulting annular water turbulence between the conductor pipe B2 and the 20 inch casing string C2 flushes the unconsolidated cement above the 20 inch casing hanger assembly 5 through the upper portion of annular space I and up to the top of the two casing strings where it is discharged. After flushing for a suitable length of time, the isolation port sleeve 18 is lowered by rotating the drill string in the opposite direction thereby closing and sealing the isolation ports 19. This procedure removes only the cement above the casing hanger assembly 5 allowing the casing above it to be disconnected from the casing hanger after drilling the well and reconnected during the tie-back operation and after the platform has been installed. This completes the installation of the second casing string C.

4.3 INSTALLATION OF THE THIRD (FIRST PRODUCTION) CASING STRING

In the next step of operation, a blow-out-preventor is installed on top of the 20 inch casing C and the well is drilled further to the desired depth for the 13⅜ inch casing string D. After that depth have been achieved, the third casing string is installed, landing the 13⅜ inch casing hanger support ring 25 inside of the 20 inch casing hanger assembly 5 and supporting it with the load shoulder 11. This casing string D is then cemented in place. Cement is pumped down through drill pipe lowered into the casing string D and cement is caused to flow out under the end of the casing and upwardly around the casing string D in the annular space II filling that space.

Prior to the cement hardening, it is again necessary to wash out the unconsolidated cement above the top of the casing hanger 30 in order to enable the running tool assembly 31 to be released after the well has been drilled. To accomplish this, the 13⅜ inch casing D is rotated to the right causing the 13⅜ inch running tool assembly 31 to rise and thereby expose the appropriate wash ports 34 to the annular space II between the inside of the 20 inch casing C2 and the outside of the 13⅜ inch casing D2. Water is then pumped down the 13⅜ inch casing string D and through the wash ports 34. The resulting water turbulence in the annular space II flushes unconsolidated cement above the top of the 13⅜ inch casing hanger assembly 30 up through annular space II to the top of the three casing strings where it is discharged. After flushing for a suitable length of time, the wash ports 34 are closed and sealed by rotating the 13⅜ inch casing string D in the opposite direction causing the 13⅜ inch running tool assembly 31 to descend and fully engage the 13⅜ inch casing hanger assembly 31. This procedure removes the cement above the casing hanger assembly 30 allowing the casing above it to be disconnected from the casing hanger after drilling the well and allowing the casing to be reconnected during the tie-back operation, after the platform has been installed.

The third casing string D has been installed to the required depth. Once it is cemented in place, the casing joint is installed with duplicate joints to extend fully to the surface in order to establish the casing D2. The left side of FIG. 1 shows the running tool assembly 31 associated with this casing string D2. This running tool includes the port 34 for washing purposes. On the right side of FIG. 1, the tie-back tool assembly 63 is illustrated. It is used for reinstallation of the upper (or uncemented) part of the third casing string D.

4.4 INSTALLATION OF THE FOURTH (SECOND PRODUCTION) CASING STRING

The well is drilled to the desired total depth. The fourth casing string E is then installed. This casing string requires installation joint by joint to the total depth in the usual manner with the casing hanger assembly 38 located at an elevation of the approximate depth of the sea floor. It is installed with the running tool assembly 49 which is shown on the left side of FIG. 1 in the casing string E and, more particularly, the casing joint 53.

The fourth casing string E is lowered through the 13⅜ inch casing D and is supported with a single piece, detent finger sleeve 37. As mentioned above, the detent finger sleeve is formed with a plurality of splits in it alternating from the two respective ends of the detent sleeve. The radial, outward spring bias on the top detent fingers 39 causes them to snap into position in the female profile 36 in the third casing hanger body 23 and the lower detent fingers 40 expand and slide over the detent upset 41 on the exterior of the fourth casing hanger body 43. Once the hanger detent finger sleeve has shifted to the locked position, the installation of the forth casing string is perfected. The circumferentially ribbed profile 36 is located internally in the lower portion of the third casing hanger body 23. The top of the hanger detent finger sleeve 39 supports a downwardly facing shoulder 42 on the fourth casing hanger body 43 thereby supporting the fourth casing string E. The shoulder 26 on the third casing hanger body 23 applies the weight of the third casing string D to an integrally connected support ring 25 which is in turn supported by the second casing hanger load shoulder 11.

A casing hanger running tool assembly 49 is engaged in the threaded female profile of the casing hanger left hand running thread profile 52. The casing hanger running tool assembly features a port 51 which is duplicated at several locations around the top of the casing hanger running tool assembly. This port 51 is included so that cement washing can be accomplished once the port(s) is exposed. As illustrated, the port 51 is closed, and there is a metal-to-metal seal above the port 51 and an elastomer, O-ring seal is below. These are key features of the casing hanger running tool body 50. Similarly to the flushing operation described above, the fourth casing string E is rotated, the running tool assembly 49 backs off the female threaded profile on the interior of the casing hanger assembly 38 to clear the port 51. Wash fluid is pumped down through the casing string E and delivered through the port 51 to flush unconsolidated cement from the annular space III up the exterior of casing E2 and is discharged at the top of the casing. Upon completion of the flushing operation, the installation of the fourth casing string E is complete.

In summary, the foregoing sets out the preferred form of the apparatus and describes a method of use or installation. This installation described includes the sequence of events when first drilling the well from a temporary support platform which is ordinarily a jack-up rig. Another aspect of the installation involves removal of the casing in all lines above the sea bed at the time the jack-up rig is moved away. Assume, for purposes of description, the well is a success and the jack-up rig is moved to another drilling location while waiting for the construction of a permanent platform to be placed over the well. The permanent platform is constructed and towed to that area and positioned above the well. At that time, the permanent or fixed platform is supported on the sea bed, and communication is reestablished with the well. At that juncture, the well is shut in and not complete, but isolated from the ocean. This isolation protects the well from the intrusion of sea water or other damage which might derive from invasion. In any case, when the permanent platform is installed over the well, the well is reassembled by positioning the various casing strings from the platform extending to the well. Commonly, the well is reestablished and completion is accomplished which involves certain downhole perforation steps through the cased well. All of this can be done using the procedure of the present invention which especially enables the weight of the well to be supported at the mudline. More importantly, when the casing strings are disconnected and later reconnected, the connections are made in accordance with the present disclosure.

While the foregoing is directed to the preferred embodiment of both the method and apparatus, the scope is determined by the claims which follow.

What is claimed is:

1. A method of drilling a well comprising the steps of:

(a) initially drilling a well from a drilling rig located above a body of water wherein the well is formed with at least (i) a large conductor pipe string from the rig through the mudline and therebelow;

(ii) an intermediate pipe string concentric in the conductor pipe string and extending deeper therebelow;

(iii) a production pipe string in the intermediate pipe string and extending toward a formation for production;

(b) supporting the production pipe string on a surrounding sleeve wherein the sleeve:

(i) is formed width deflectable fingers;

(ii) during running, is sized to fit on the exterior of the production pipe string for installation in the well;

(iii) is internally profiled to snap into and lock at a particular conforming production pipe string sleeve containing receptacle;

(iv) is externally profiled to lock at a particular conforming sleeve receiving receptacle so that said sleeve is fixed against further axial movement;

(v) is externally sharpened in serrations to grip and prevent axial movement after locking in the particular conforming sleeve receiving receptacle;

(vi) cut lengthwise from one end with a set of slots to define a set of deflectable fingers;

(vii) cut lengthwise from a second end with a second set of slots to define a second set of deflectable fingers; and (viii) wherein said first and second sets of fingers overlap so that said sleeve expands or contracts radially to enable seating on installation;

(c) supporting the weight of the conductor pipe string, intermediate pipe string and production pipe string at the mudline;

(d) disconnecting temporarily all pipe strings at the mudline;

(e) later reconnecting all pipe strings at the mudline;

(f) and wherein the step of disconnecting includes disconnecting at a running tool located at the mudline; and (g) wherein the step of later reconnecting the pipe strings includes connecting at the mudline with a tie-back tool so that all pipe strings extend to above the surface of the body of water.

2. The method of claim 1 wherein said sleeve is installed on a particular production pipe string joint prior to running in the well, and said sleeve snaps and locks at the conforming sleeve receiving receptacle located in a larger pipe string and located below a point of disconnection for the larger pipe string.

3. The method of claim 2 including the preliminary step of positioning the larger pipe string conforming sleeve receiving receptacle below a running tool in the larger pipe string.

4. The method of claim 1 wherein said sleeve is:

(a) formed of a single, encircling metal member; and (b) shaped with plural slots so that hoop stresses acting on said sleeve change the diameter thereof to accomplish sleeve fitting around the production pipe string.

5. The method of claim 1 wherein said sleeve is:

(a) locked at external and internal profiles to grip against relative axial movement along said production pipe string;

(b) weighted with the weight of the production pipe string so that the weight moves said sleeve to lock in location; and (c) contacted fully therearound to comprise the sole hanger on the exterior of said production pipe string.

6. A mudline casing hanger suspension system comprising:

(a) a conductor pipe string having an internal shoulder therein located along said string so that said shoulder is located near the mudline below a body of water;

(b) a smaller pipe string fitting in said conductor pipe string so that said smaller pipe string extends below said conductor pipe to greater depths;

(c) an external casing hanger around said smaller pipe to support the weight of said smaller pipe through said casing hanger on said conductor pipe string;

(d) an internal receptacle in said smaller pipe string (i) spaced therealong so that said receptacle is below said external casing hanger to shift weight to said casing hanger; and (ii) profiled to receiving and hold a conforming surface therein;

(e) an elongate sleeve having (i) a conforming surface matching said internal receptacle;

(ii) an encircling continuous sleeve of metal responding to hoop stresses to radially deflect to lock in place;

(f) a production pipe string centered in said sleeve and having (i) an external receptacle conforming to said sleeve;

(ii) an encircling lock surface at said external receptacle to enable locking said sleeve;

(g) a running tool serially in said production pipe string threaded and sealed in said pipe string; and (h) a moveable sleeve in said production pipe string movably mounted to open and close over a set of perforations through said sleeve to a surrounding annular space to wash cement slurry in said annular space so that said production pipe string can be cemented in the annular space and is not cemented above said ring.

7. The apparatus of claim 6 wherein said conductor pipe string surrounds said smaller pipe string and said smaller pipe string is concentric therein supported by said conductor pipe, and further including:

(a) a moveable sleeve within said smaller pipe string wherein said sleeve opens or closes to provide a circulation path through a set of perforations in said smaller pipe string to enable washing in the annular space on the exterior of said smaller pipe string;

(b) and wherein said perforations are connected to the exterior of said smaller pipe string so that said smaller pipe string can be cemented in place within said conductor pipe string and the cement in the annular space on the interior of said conductor pipe string and exterior of said smaller pipe string is permitted to cure up to a selected height and is washed away by wash fluid through said perforations and into the annular space on the exterior of said smaller pipe string.

8. The apparatus of claim 7 wherein said sleeve is detent engaged and is adapted to be lowered on a running tool in said smaller pipe string.

9. The apparatus of claim 6 wherein said running tool is serially installed with said smaller pipe string and said running tool has a metal upper circular edge seated against a rotating seal and includes a bearing raceway.

10. The apparatus of claim 9 wherein said running tool unthreads from the smaller pipe string.

11. The apparatus of claim 6 including a detachable tie-back tool serially and alternately installed in said production pipe string in place of said running tool; and wherein said running tool incorporates said moveable sleeve.

12. The apparatus of claim 6 wherein said running tool threads and unthreads at a metal sealing surface.

13. The apparatus of claim 6 wherein said elongate sleeve has an upper shoulder which is sharply serrated therearound, and has a tapered lower end formed of a plurality of fingers arranged in a circle and said fingers include an internal shoulder enabling said fingers to snap and lock in place.

14. The apparatus of claim 13 wherein said internal shoulder is adjacent to a measured flat and said flat matches a profile area on said production pipe string.

15. The apparatus of claim 6 further including a larger pipe string around said smaller pipe string wherein said larger and smaller pipe strings transfer the respective weight of each of said pipe strings to said conductor pipe string; and a connective casing hanger between said larger and smaller production pipe strings comprises:

(a) an elongate sleeve therebetween having
  (i) a conforming surface on the interior thereof;
  (ii) an encircling sleeve of continuous metal responding to stresses applied thereto to radially deflect enable said sleeve to fit;

(b) an encircling receptacle on the exterior of said smaller pipe string for matching said elongate sleeve and enabling said sleeve to uniquely fit therein;

(c) an encircling receptacle on the interior of said larger pipe string matching and conforming to said elongate sleeve to uniquely permit said sleeve to fit therein; and (d) a latching shoulder in said elongate sleeve to latch and lock said sleeve in place during running on said smaller pipe string.

16. The apparatus of claim 15 including a bearing raceway connecting said running tool.

17. The apparatus of claim 16 wherein said running tool seals on a circular metal surface.

18. A mudline casing hanger suspension system comprising:

(a) a pipe section sized to a conductor pipe having an internal shoulder therein located so that said shoulder is located near the mudline below a body of water;

(b) an external shoulder sized to land on said internal shoulder wherein said external shoulder may support a smaller pipe string below said conductor pipe and extending to greater depths;

(c) an internal receptacle concentric with said smaller external shoulder and
  (i) spaced therealong so that said receptacle is below said external shoulder to shift weight to said shoulder; and
  (ii) profiled to receive and hold a conforming surface therein;

(d) an elongate sleeve having
  (i) a conforming surface matching said internal receptacle;
  (ii) an encircling continuous sleeve of metal responding to hoop stresses to radially deflect to lock in place;

(e) a production pipe joint centered in said sleeve and having
  (i) an external receptacle conforming to said sleeve;
  (ii) an encircling lock surface at said external receptacle to enable locking said sleeve;

(f) a running tool serially connected to said production pipe joint; and (g) a moveable sleeve in said production pipe joint movably mounted to open and close over a set of perforations through said sleeve to a surrounding annular space to wash cement slurry in said annular space so that said production pipe joint can be cemented in the annular space and is not cemented above said perforations.

19. The apparatus of claim 18 wherein said conductor pipe joint surrounds said smaller pipe joint and said smaller pipe joint is concentric therein supported by said conductor pipe section, and further including:

(a) a moveable sleeve within said smaller pipe joint wherein said sleeve opens or closes to provide a circulation path through a set of perforations in said smaller pipe string to enable washing in the annular space on the exterior of said smaller pipe joint;

(b) and wherein said perforations are connected to the exterior of said smaller pipe joint so that said smaller pipe joint can be cemented in place within said conductor pipe joint and the cement in the annular space on the interior of said conductor pipe section and exterior of said smaller pipe joint is permitted to cure up to a selected height and is washed away by wash fluid through said perforations and into the annular space on the exterior of said smaller pipe joint.

20. The apparatus of claim 19 wherein said sleeve is detent engaged and is adapted to be lowered on a running tool.

21. The apparatus of claim 18 wherein said running tool is serially installed with said smaller pipe joint and said running tool has a metal upper circular edge seated against a rotating seal and includes a bearing raceway.

22. The apparatus of claim 21 wherein said running tool unthreads relative to the smaller pipe joint.

23. The apparatus of claim 18 including a detachable tie-back tool serially and alternately installed with said production pipe joint in place of said running tool; and wherein said running tool incorporates said moveable sleeve.

24. The apparatus of claim 18 wherein said running tool threads and unthreads at a metal sealing surface.

25. The apparatus of claim 18 wherein said elongate sleeve has an upper shoulder which is sharply serrated therearound, and has a tapered lower end formed of a plurality of fingers arranged in a circle and said fingers include an internal shoulder enabling said fingers to snap and lock in place.

26. The apparatus of claim 25 wherein said internal shoulder is adjacent to a measured flat and said flat matches a profile area on said production pipe joint.

* * * * *